US006131514A

United States Patent [19]

Simons

[11] Patent Number: 6,131,514

[45] Date of Patent: Oct. 17, 2000

[54] METHOD OF MAKING A PRINTING PLATE WITH AN INK JET FLUID MATERIAL

[75] Inventor: Michael J. Simons, Ruislip, United Kingdom

[73] Assignee: Eastman Kodak Company, Rochester, N.Y.

[21] Appl. No.: 09/218,697

[22] Filed: Dec. 22, 1998

[30] Foreign Application Priority Data

Dec. 24, 1997 [GB] United Kingdom ..... 97027139

[51] Int. Cl.[7] ..... B41C 1/10

[52] U.S. Cl. ..... 101/466; 101/463.1

[58] Field of Search ..... 101/466, 465, 101/463.1, 457, 459

[56] References Cited

U.S. PATENT DOCUMENTS 5,695,908 12/1997 Furukawa ..... 101/466

5,738,013 4/1998 Kellett ..... 101/463.1

5,820,932 10/1998 Hallman et al. ..... 101/463.1

FOREIGN PATENT DOCUMENTS 53-015905 2/1978 Japan .

56-105960 8/1981 Japan .

*Primary Examiner*—John S. Hilten

*Assistant Examiner*—Leslie J. Grohusky

[57] ABSTRACT

A method of preparing a printing plate comprises producing an oleophilic image on the surface of a support by ink-jet printing the image on the surface using an aqueous solution or aqueous colloidal dispersion of a polymer bearing water-solubilizing groups wherein the water-solubilizing groups interact with the surface of the support thereby binding the polymer to the support and rendering the polymer insoluble.

16 Claims, No Drawings

METHOD OF MAKING A PRINTING PLATE WITH AN INK JET FLUID MATERIAL

FIELD OF THE INVENTION

The invention relates to a printing plate and a method of preparing the plate.

BACKGROUND OF THE INVENTION

Printing plates suitable for offset lithographic printing are known which comprise a support having a surface having non-image areas which are hydrophilic and image areas which are hydrophobic and ink-receptive.

The art of lithographic printing is based upon the immiscibility of oil and water, wherein the oily material or ink is preferentially retained by the image area and the water or fountain solution is preferentially retained by the non-image area. When a suitably prepared surface is moistened with water and an ink is then applied, the background or non-image area retains the water and repels the ink while the image area accepts the ink and repels the water. The ink on the image area is then transferred to the surface of a material upon which the image is to be reproduced; such as paper, cloth and the like. Commonly the ink is transferred to an intermediate material called the blanket which in turn transfers the ink to the surface of the material upon which the image is to be reproduced.

Ink-jet printing is a non-impact method for producing images by the deposition of ink droplets on a substrate in response to digital signals.

JP-A-53015905 describes the preparation of a printing plate by ink-jetting an alcohol-soluble resin in an organic solvent onto an aluminium plate.

JP-A-56105960 describes the formation of a printing plate by ink-jetting onto a support e.g. an anodised aluminium plate an ink capable of forming an oleophilic image and containing a hardening substance such as epoxy-soybean oil together with benzoyl peroxide, or a photo-hardening substance such as an unsaturated polyester.

A method of preparing printing plates using the ink-jetting technique is required which avoids the use of organic solvents and/or light-sensitive materials.

SUMMARY OF THE INVENTION

The invention provides a method of preparing a printing plate comprising:

imagewise ink-jet printing an oleophilic image on a surface of a support by applying to the support an aqueous solution or aqueous colloidal dispersion of a polymer having water-solubilising groups, wherein the water-solubilising groups interact with the support surface, thereby binding the polymer to the support surface and rendering the polymer insoluble.

The method of the invention offers a rapid, simple and direct way to make a printing plate from digital data, using relatively low cost equipment and without light-sensitive materials.

Compared with the ways of preparing a printing plate disclosed in the prior art, the method of the invention requires no processing of the plate and uses dilute aqueous solutions having a low level of environmental impact and low health risk.

DETAILED DESCRIPTION OF THE INVENTION

The image on the surface of the printing plate is produced using an aqueous solution or aqueous colloidal dispersion of a polymer having water-solubilising groups. The image written to the printing plate becomes hydrophobic and ink-receptive to give a plate suitable for offset lithographic printing.

Preferably, the polymer comprises a substantially non-polar or hydrophobic backbone chain bearing pendant groups which contain water-solubilising groups.

The water-solubilising groups and the support are chosen so that the water-solubilising groups interact with the surface of the support thereby binding the polymer to the support. Various forms of interaction are possible including chemical or physical interactions such as ionic interactions, covalent bonding, hydrogen bonding and the formation of coordination complexes. By interaction with the surface of the support the groups lose their ability to confer water-solubility on the polymer and the polymer is rendered insoluble.

Suitable water-solubilising groups include ionisable acid groups including carboxylic acid groups and sulphonic acid groups. The groups may be ionised so that the polymer is in the form of a salt. The salt may be an alkali metal or ammonium salt. The alkali metal may be sodium or potassium and the ammonium ion may be quaternised for example a tetraalkyl ammonium ion such as tetramethyl or tetrabutyl ammonium.

The support may be any support suitable for printing plates. Typical supports include metallic and polymeric sheets or foils. The surface of the support may be treated or coated to provide the necessary interaction with the polymer. Examples of surface coatings include a metallic oxide and gelatin coatings.

Preferably, a support having a metallic surface is used. Preferably, the metallic surface is oxidised.

In a particularly preferred embodiment of the invention, a support having an anodised aluminium surface is employed.

The proportion of water-solubilising groups must be sufficient to confer water solubility or water-dispersibility on the polymer, but low enough that the polymer when adsorbed on the printing plate gives an oleophilic surface. The proportion of free water-solubilising groups may be varied through the proportions of monomers used to form the polymer, or by derivatising a fraction of the water-solubilising groups present in the polymer. For example, the proportion of free carboxylic acid groups may be varied by esterification.

The hydrophobic backbone may be essentially a hydrocarbon chain, as in polymers or copolymers prepared by the polymerisation of ethylenically unsaturated monomers. Examples of suitable monomers include ethylene, propylene, styrene, vinyl ethers, acrylamide, methacrylamide, acrylic acid, methacrylic acid, maleic acid, maleic anhydride and 2-acrylamido-2-methylpropanesulphonic acid. Alternatively, the hydrophobic backbone could be another type of chain such as a polyester chain.

Suitable polymers include copolymers of ethylene and acrylic acid, and copolymers of styrene with acrylic or maleic acids.

Particularly suitable polymers include poly(ethylene-co-acrylic acid), sodium salt, containing 10 to 20 wt % e.g. 15 wt % acrylic acid.

The concentration of polymer in the solution used in the ink jet printer may be in the range 0.02 to 5% by weight, with a preferred range of 0.05 to 1.0% by weight.

It is necessary that the polymer is in the form of an aqueous solution or a stable colloidal dispersion, so that it can pass through the jets of the printer head.

While water is the preferred aqueous carrier medium, the aqueous composition may comprise one or more water miscible solvents e.g. a polyhydric alcohol such as ethylene glycol, diethylene glycol, triethylene glycol or trimethylol propane. The amount of aqueous carrier medium in the aqueous composition may be in the range from 30 to 99.995, preferably from 50 to 95% by weight.

Jet velocity, separation length of the droplets, drop size and stream stability are greatly affected by the surface tension and the viscosity of the aqueous composition. Ink-jet inks suitable for use with ink-jet printing systems may have a surface tension in the range from 20 to 60, preferably from 30 to 50 dynes/cm. Control of surface tensions in aqueous inks may be accomplished by additions of small amounts of surfactants. The level of surfactants to be used can be determined through simple trial and error experiments. Anionic and nonionic surfactants may be selected from those disclosed in U.S. Pat. Nos. 5,324,349; 4,156,616 and 5,279,654 as well as many other surfactants known in the ink-jet art. Commercial surfactants include the Surfynol™ range from Air Products; the Zonyl™ range from DuPont; the Fluorad™ range from 3M and the Aerosol™ range from Cyanamid.

The viscosity of the ink is preferably no greater than 20 centipoise e.g. from 1 to 10, preferably from 1 to 5 centipoise at room temperature.

The solution used in the ink jet printer may comprise other ingredients, for instance water-soluble liquids or solids with a substantially higher boiling point than water, e.g. ethanediol, as well as other types of oleophile precursors such as the sodium salt of oleic acid. A humectant or co-solvent may be included to help prevent the ink from drying out or crusting in the orifices of the print head. A penetrant may also be optionally added to help the ink penetrate the surface of the support. A biocide, such as Proxel™ GXL from Zeneca Colours may be added to prevent unwanted microbial growth which may occur in the ink over time. Additional additives which may be optionally present in the ink include thickeners, pH adjusters, buffers, conductivity enhancing agents, anti-kogation agents, drying agents and defoamers.

The aqueous composition is employed in ink-jet printing wherein drops of the composition are applied in a controlled fashion to the surface of the support by ejecting droplets from a plurality of nozzles or orifices in a print head of an ink-jet printer.

Commercially available ink-jet printers use several different schemes to control the deposition of the ink droplets. Such schemes are generally of two types: continuous stream and drop-on-demand.

In drop-on-demand systems, a droplet of ink is ejected from an orifice directly to a position on the ink receptive layer by pressure created by, for example, a piezoelectric device, an acoustic device, or a thermal process controlled in accordance with digital signals. An ink droplet is not generated and ejected through the orifices of the print head unless it is needed. Ink-jet printing methods and related printers are commercially available and need not be described in detail.

The aqueous composition may have properties compatible with a wide range of ejecting conditions, e.g. driving voltages and pulse widths for thermal ink-jet printers, driving frequencies of the piezoelectric element for either a drop-on-demand device or a continuous device, and the shape and size of the nozzle.

The support for the lithographic printing plate is typically formed of aluminium which has been grained, for example by electrochemical graining, and then anodized, for example, by means of anodizing techniques employing sulfuric acid and/or phosphoric acid. Methods of both graining and anodizing are very well known in the art and need not be further described herein.

After writing the image to the printing plate, the printing plate may be inked with printing ink in the normal way, and the plate used on a printing press. Before inking, the plate may be treated with an aqueous solution of natural gum, such as gum acacia, or of a synthetic gum such as carboxymethyl cellulose, as is well known in the art of printing—see for example Chapter 10 of "The Lithographer's Manual", edited by Charles Shapiro and published by The Graphic Arts Technical Foundation, Inc., Pittsburgh, Pa. (1966).

The invention is further illustrated by way of example as follows.

EXAMPLE 1

To 15 g of water was added 2 g of a 2% by weight aqueous solution of poly(ethylene-co-acrylic acid), sodium salt, containing 15 wt % acrylic acid, supplied by Aldrich, 2 g of a 50% by weight aqueous solution of sorbitol, and 1 g of ethanediol.

The solution was loaded into the black ink cartridge of a Lexmark 7000 ink-jet printer, the cartridge having previously been emptied and cleaned.

An image comprising a picture together with alphanumeric text was prepared using word processing software in a personal computer, and written onto a sheet of anodised aluminium printing plate material which had been loaded into the printer. The plate was removed and mounted on a Heidelberg "T-Offset" lithographic printing press, it was wetted with "Varn Press Master Universal Fountain Solution" diluted 1 part with 30 parts by volume of water, and run on the press using "VanSon VS310 Rubber Base Plus" printing ink. 3000 sheets of paper were printed with the pictorial alphanumeric text image without deterioration of the plate. The prints were clear, clean and sharp.

EXAMPLE 2

The experiment was conducted in the same way as Example 1, except the solution loaded into the ink jet cartridge was prepared as follows:

To 12.5 g of water was added 2 g of a 2% by weight aqueous solution of poly(ethylene-co-acrylic acid), sodium salt, containing 15 wt % acrylic acid, supplied by Aldrich, 2 g of a 50% by weight aqueous solution of sorbitol, 1 g of ethanediol, and 2.5 g of a solution of sodium oleate prepared by stirring 1.0 g of oleic acid and 1.1 ml of 4M sodium hydroxide solution in 198 g of water.

The results were very similar to those of Example 1.

EXAMPLE 3

Comparative Example

The experiment was conducted in the same way as Example 1, except the solution loaded into the ink jet cartridge was prepared as follows:

To 14 g of water was added 4 g of a 50% by weight aqueous solution of sorbitol, 2 g of ethanediol, and 20 g of a solution of sodium oleate prepared by stirring 1.0 g of oleic acid and 1.1 ml of 4M sodium hydroxide solution in 198 g of water.

On running the resulting plate on the press, it was observed that the prints were less sharp than those of Examples 1 and 2, and that after 3000 impressions there were signs of deterioration in the smallest dots on the printing plate.

EXAMPLE 4

This example illustrates the use of another polymer of the invention.

The experiment was conducted in the same way as Example 1, except the solution loaded into the ink jet cartridge was prepared as follows:

To 9 g of water was added 8 g of a 1% by weight aqueous solution of polymer, 2 g of a 50% by weight aqueous solution of sorbitol, and 1 g of ethanediol. The aqueous solution of polymer was prepared by taking 1.0 g of poly (styrene-co-maleic acid), partial isobutyl/methyl mixed ester, having a molecular weight of about 180,000, a 1:1 molar ratio of styrene to maleic acid, and unspecified ratios of ester groups (supplied by Aldrich), stirring it with 100 g of water to which was added 1.0 ml of 4M sodium hydroxide solution, until dissolved, and filtering the resultant solution to remove any undissolved material.

The resultant printing plate when put on the press took several revolutions of the press to ink up, but then delivered clear prints of the test image.

EXAMPLE 5

This example illustrates the application of the invention to a printing plate support having a polymeric (gelatin) surface.

To 14 g of water was added 4 g of a 2% by weight aqueous solution of poly(ethylene-co-acrylic acid), sodium salt, containing 15 wt % acrylic acid, supplied by Aldrich, and 2 g of ethanediol.

The solution was loaded into the black ink cartridge of a Lexmark 7000 ink-jet printer, the cartridge having previously been emptied and cleaned.

An image comprising alphanumeric text was prepared using word processing software in a personal computer, and written onto a sheet of processed Kodak™ Royal Ektacolor™ Paper which had been loaded into the printer.

The printed image was allowed to dry, then the gelatin surface of the photographic paper was moistened with a piece of cotton wool which had been soaked with water. Then a little printing ink ("VanSon VS310 Rubber Base Plus") was applied to the moist cotton wool and gently rubbed on to the surface of the photographic paper. The printing ink adhered to the areas which had been written to by the ink-jet printer but not to the other areas, giving a clear image in printing ink of the alphanumeric text, thus showing a clear lithographic differential.

The invention has been described in detail with particular reference to certain preferred embodiments thereof, but it will be understood that variations and modifications can be effected within the spirit and scope of the invention.

What is claimed is:

1. A method of preparing a printing plate comprising:

imagewise ink-jet printing an oleophilic image on a surface of a support by applying to said support an aqueous solution or aqueous colloidal dispersion of a polymer having water-solubilising groups, wherein said water-solubilising groups interact with said support surface, thereby binding said polymer to said support surface and rendering said polymer insoluble.

2. The method of claim 1 wherein said water-solubilising groups are ionisable acid groups.

3. The method of claim 2 wherein said water-solubilising groups are selected from the group consisting of carboxylic and sulphonic acid groups.

4. The method of claim 1 wherein said polymer is derived from the polymerisation of ethylenically unsaturated monomers.

5. The method of claim 1 wherein said polymer is selected from copolymers of ethylene and acrylic acid, and copolymers of styrene with acrylic or maleic acids.

6. The method of claim 1 wherein said polymer is poly(ethylene-co-acrylic acid), sodium salt, containing 10 to 20 wt % acrylic acid.

7. The method of claim 1 wherein said polymer is present in said aqueous solution or aqueous colloidal dispersion in the range 0.02 to 5% by weight.

8. The method of claim 1 wherein said polymer is present in said aqueous solution or aqueous colloidal dispersion in the range 0.05 to 1.0% by weight.

9. The method of claim 1 wherein the amount of water in said aqueous solution or aqueous colloidal dispersion is from 30 to 99.995% by weight.

10. The method of claim 1 wherein said surface of said support is a metallic surface.

11. The method of claim 10 wherein said metallic surface is an aluminium surface.

12. The method of claim 11 wherein said metallic surface is oxidised.

13. The method of claim 1 wherein said aqueous solution or colloidal dispersion further comprises a water-miscible solvent.

14. The method of claim 1 wherein said aqueous solution or colloidal dispersion has a surface tension in the range of from 20 to 60 dynes/cm.

15. The method of claim 1 wherein said aqueous solution or colloidal dispersion has a viscosity of no greater than 20 centipoise as measured at room temperature.

16. The method of claim 1 wherein said aqueous solution or colloidal dispersion further comprises a surfactant, humectant, penetrant, biocide, thickener, pH adjuster, buffer, conductivity enhancing agent, anti-kogation, drying agent or defoamer.

* * * * *